US007597725B2

(12) United States Patent
Caprotti et al.

(10) Patent No.: US 7,597,725 B2
(45) Date of Patent: Oct. 6, 2009

(54) ADDITIVES AND FUEL OIL COMPOSITIONS

(75) Inventors: Rinaldo Caprotti, Oxford (GB); Carlo S. Fava, Oxford (GB); Graham Jackson, Caversham Reading (GB); Iain More, Abingdon (GB)

(73) Assignee: Infineum International Ltd. (GB)

( * ) Notice: Subject to any disclaimer, the term of this patent is extended or adjusted under 35 U.S.C. 154(b) by 438 days.

(21) Appl. No.: 10/675,171

(22) Filed: Sep. 30, 2003

(65) Prior Publication Data

US 2004/0123517 A1 Jul. 1, 2004

(51) Int. Cl.
*C10L 1/18* (2006.01)

(52) U.S. Cl. ..... 44/385; 44/408

(58) Field of Classification Search ..... 44/385, 44/388, 408; 508/536, 539
See application file for complete search history.

(56) References Cited

U.S. PATENT DOCUMENTS

| | | | | |
|---|---|---|---|---|
| 4,248,182 | A | 2/1981 | Malec | 123/1 A |
| 6,610,111 | B2 * | 8/2003 | Krull et al. | 44/385 |

FOREIGN PATENT DOCUMENTS

| | | | |
|---|---|---|---|
| EP | 0 635 558 | A1 | 1/1995 |
| WO | WO97/04044 | A1 | 2/1997 |
| WO | WO01/88064 | A2 | 11/2001 |

* cited by examiner

*Primary Examiner*—Cephia D Toomer

(57) ABSTRACT

An additive composition for a fuel oil composition and that is free of polycyclic carboxylic acids and of acid derivatives thereof comprises an additive that comprises one or more monocarboxylic acids, each having from 10 to 24 carbon atoms, or acid derivatives thereof, optionally in combination with one or both of an anti-oxidant additive and an anti-static additive.

13 Claims, No Drawings

ADDITIVES AND FUEL OIL COMPOSITIONS

This invention relates to additive compositions for fuel oils.

The use of fatty acids and their derivatives as additives for fuel compositions is known in the art. Examples of such acids include those derived from vegetable oils and from tall oil and those derived from other sources such as animal fat and fish oils. Their use as fuel lubricity additives in low-sulphur content fuels is particularly noteworthy.

Examples of publications that describe the above use include: WO-A-94/17160; U.S. Pat. No. 3,273,981; and EP-A-0 839 174.

Further, WO-A-98/04656 describes a low-sulphur content fuel for diesel engines containing a lubricating additive comprising monocarboxylic and polycyclic acids, such as resin acids (sometimes referred to as rosin acids).

A drawback associated with use of additives described in the art is the low-temperature behaviour of one or more of the additives themselves (including specific components thereof), packages incorporating the additives, and fuel compositions containing the additives. Such drawbacks can arise because the additives are mixtures of components of differing solubilities: at low temperatures, the least, or lesser, soluble components fall out of solution resulting in separation of additive and poor fuel filterability. Also, the presence of polycyclic acids has a deleterious effect on the performance of any antistatic additives that may be present.

This invention meets the above-mentioned problems by not employing polycyclic acids or their derivatives and, where necessary, by controlling the percentage by mass of unsaturated, including polyunsaturated, acids and of saturated acids in an additive.

Thus, a first aspect of the invention is an additive composition that is free of polycyclic carboxylic acids and of acid derivatives thereof, for a fuel oil composition, comprising: an additive, (a), comprising a plurality of monocarboxylic acids, each having from 10 to 24 carbon atoms, or acid derivatives thereof, less then 7, such as less than 5, 4, 3, 2 or 1, mass % of which acids or acids from which said derivatives are derived having a linear chain and being saturated, and the balance being unsaturated, at least 35, such as at least 40, to at most 85, mass % of which balance being polyunsaturated. For example, said balance may have at most 65, at most 70, at most 75, or at most 80, mass % polyunsaturated acids.

A second aspect of the invention is an additive composition that is free of polycyclic carboxylic acids and of acid derivatives thereof, for a fuel oil composition, comprising or obtainable by mixing:

an additive, (a'), comprising a plurality of monocarboxylic acids, each having from 10 to 24 carbon atoms, or acid derivatives thereof, less than 7, such as less then 5, 4, 3, 2 or 1, mass % of which acids or acids from which said derivatives are derived having a linear chain and being saturated, and the balance being unsaturated, at least 35, such as at least 40, mass % of which balance being polyunsaturated; and either or both of an additive, (b), in the form of an antioxidant additive and an additive, (c), in the form of an electrical-conductivity improver additive.

A third aspect of the invention is an additive composition that is free of polycyclic carboxylic acids and of acid derivatives thereof, for a fuel oil composition, comprising or obtainable by mixing:

an additive, (a"), comprising one or more monocarboxylic acids, the or each acid having from 10 to 24 carbon atoms, or acid derivatives thereof; and an additive, (c), in the form of an electrical-conductivity improver additive.

A fourth aspect of the invention is a fuel oil composition that is free of polycyclic carboxylic acids and of acid derivatives thereof comprising or obtainable by mixing a fuel oil, in a major proportion, and an additive composition of any of the first, second and third aspects of the invention, in a minor proportion.

A fifth aspect of the invention is the use of an additive composition of any of the first, second and third aspects of the invention for improving one or more of the operability, filterability, electrical conductivity and anti-oxidancy of a fuel oil. It should be noted that the anti-oxidancy of the additive composition itself may also be improved.

A sixth aspect of the invention is the use of an additive, (a"), comprising one or more monocarboxylic acids, the or each acid having from 10 to 24 carbon atoms, or acid derivatives thereof to improve the electrical conductivity of a fuel oil composition that contains an electrical-conductivity improver additive and that is free of polycyclic carboxylic acids and of acid derivatives thereof.

A seventh aspect of the invention is a method of operating an internal combustion engine using, as fuel for the engine, a fuel oil composition of the fourth aspect of the invention.

As evidenced in the examples of this specification, the invention enables the above-mentioned problems to be ameliorated.

In this specification, the following words and expressions shall have the meanings ascribed below:

"active ingredients" or "(a.i.)" refers to additive material that is not diluent or solvent;

"comprises" or "comprising" or any cognate word specifies the presence of stated features, steps, integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies.

"major amount" means in excess of 50 mass % of a composition;

"minor amount" means less than 50 mass % of a composition.

Also, it will be understood that various components used, essential as well as optimal and customary, may react under conditions of formulation, storage or use and that the invention also provides the product obtainable or obtained as a result of any such reaction.

Further, it is to be understood that any upper and lower quantity, range and ratio limits set forth herein may be independently combined.

The features of the invention relating, where appropriate, to each and all aspects of the invention, will now be described in more detail as follows:

Additives, (a), (a') and (a")

Preferably, the monocarboxylic acids each have from 10 to 22, more preferably 16 to 22, especially 16 to 18, more especially 18, carbon atoms.

In additives (a) and (a'), the unsaturated monocarboxylic acids may have an alkenyl, cyclo-alkenyl or aromatic hydrocarbyl group attached to the carboxylic acid group. "Hydrocarbyl" means a group containing carbon and hydrogen atoms that may be straight chain or branched (unless otherwise stated in the context) and that is attached to the carboxylic acid group by a carbon-carbon bond. Such hydrocarbyl group may be interrupted by one or more hetero atoms such as O, S, N or P that do not interfere with the essentially hydrocarbon nature of the group. The acids may be derived from natural materials such as from vegetable or animal extracts.

The poly-unsaturated acids are preferably di- or tri-unsaturated, especially preferred being linoleic acid and linolenic acid. Examples of mono-unsaturated acids, if present, are oleic acid and ricinoleic acid.

It should be noted that saturated monocarboxylic acids that have or include a branched group attached to a carboxylic acid group, or acid derivatives thereof, may be present in combination with additive(s), (a) or (a').

Suitable examples of additives, (a"), are fatty acids derived from vegetable or animal fats. Examples of oils are rapeseed oil, coriander oil, soyabean oil, linseed oil, cottonseed oil, sunflower oil, castor oil, olive oil, peanut oil, maize oil, almond oil, palm kernel oil, coconut oil, mustard seed oil, beef tallow and fish oils.

As acid derivatives of the carboxylic acids there may be mentioned esters, amides and salts such as those of alkanolamines such as diethanolamine, esters being preferred.

EP-A-0 773 278; EP-A-0 773279 and WO-A-9900467 describe examples of diethanolamines, and WO-A-0138463 describes examples of amine salts. Examples of esters includes those with polyhydric alcohols, ie having more than one hydroxy group. Preferably, the polyhydric alcohols have three or more hydroxy groups.

Examples of polyhydric alcohols that may be used to make the esters are those having from 2 to 10, preferably 2 to 6, more preferably 2, 3 or 4, hydroxy groups in the molecule, and having 2 to 90, preferably 2 to 30, more preferably 2 to 12, most preferably 2, 3, 4 or 5, carbon atoms in the molecule. Such alcohols may be aliphatic, saturated or unsaturated, and straight-chain or branched, or cyclic derivatives thereof. Saturated, aliphatic, straight-chain alcohols are preferred. Specific examples of trihydric alcohols that may be used are glycerol and trimethylol propane. Other, specific, examples of polyhydric alcohols that may be used are pentaerythritol, sorbitol, mannitol, inositol, glucose and fructose. WO-A-0119941 describes examples of esters derived from pentaerythritol.

As stated, the additive compositions of the invention are free of any polycyclic carboxylic acids or acid derivatives thereof. By "free" is meant that the amount thereof is zero or is so low that its presence has no significant or practical effect on the performance of the composition: "free" can include the presence of a trace amount.

The polycyclic acids or acid derivatives envisaged may, for example, contain at least two cycles each formed of 5 to 6 atoms one of which at most is optionally a hetero atom such as N or O and the other atoms are carbon atoms, these two cycles having, further, two carbon atoms in common, preferably vicinal, and being saturated or unsaturated and substituted or unsubstituted. For example, the polycyclic acids may be represented by the formula (I) below:

(I)

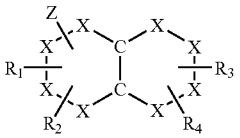

wherein

X denotes an atom of each ring which corresponds to four carbon atoms or three carbon atoms and one hetero atom such as a nitrogen atom or an oxygen atom, $R_1$, $R_2$, $R_3$ and $R_4$ each denotes a hydrogen atom or hydrocarbon group, which may be the same or different and each of which is linked to at least one atom contained in one ring of the compound, the hydrocarbon group being selected from an alkyl group having 1 to 5 carbon atoms, an aryl group or a hydrocarbon ring having 5 to 6 atoms, optionally having a hetero atom such as an oxygen atom or a nitrogen atom, two groups of Ri selected from $R_1$, $R_2$, $R_3$ and $R_4$ may form a ring optionally through a hetero atom, the ring being saturated or unsaturated, which may be unsubstituted or optionally substituted by an aliphatic group of olefin type having 1 to 4 carbon atoms, and Z denotes a carboxylic group.

Examples of acids of formula (I) are natural resin based acids obtained from resin-containing trees, especially resin-containing conifers, for example from tall oil such as by methods described in the art, eg in Kirk-Othmer, "Encyclopaedia of Chemical Technology" (Third Edition) Vol 22, ps 531-541. Specific examples of the acids are an abietic acid; dihydro-abietic acid; tetrahydro-abietic acid; dehydroabietic acid; neo-abietic acid; pimaric acid; levopimaric acid; and palustric acid.

Examples of acid derivatives envisaged include those mentioned above in respect of the monocarboxylic acids.

Other Additives

The additive compositions described in the art that contain polycyclic acids are found to have a deleterious effect on the performance of electrical-conductivity improver additives such as antistatic additives. However, the additive compositions of this invention are found to overcome this problem as will be demonstrated in the examples in this specification. Thus, in an embodiment of this invention, the additive compositions of the invention additionally comprise, unless already provided as stated above, an electrical-conductivity improver additive, (c). Such additives are sometimes referred to as anti-static additives or as conductivity improvers. Their role is to render a fuel composition electrically conducting to decrease the risk of an explosion or fire: such risk could arise from electrical charges that have accumulated in the fuel composition igniting hydrocarbon-air mixtures that may be present. As examples of such additives, (c), there may be mentioned two-component additives where one component is a polysulfone and the second component is a quaternary ammonium compound, a polyvalent metal organic compound of metals having an atomic number of from 22 to 29, or a polymeric polyamine. A polymeric polyamine is preferred as the second additive and is described in U.S. Pat. No. 3,917,466.

The polysulfone may be referred to as an olefin-sulfur dioxide copolymer, an olefin polysulfone, or a poly(olefin sulfone). It may be a linear polymer wherein the structure is considered to be that of alternating copolymers of olefins and sulfur dioxide, having a one-to-one molar ratio of the comonomers with the olefins in head-to-tail arrangement. The above-mentioned polyamine may be a polymeric reaction product of epichlorohydrin with an aliphatic primary monoamine or N-aliphatic hydrocarbyl alkylene diamine.

Such preferred two-component additives may be in combination with a strong acid, preferably an oil-soluble sulfonic acid, which forms a polyamine-acid salt with the polyamine component to improve resistance to precipitate-formation during long storage periods. An example is the material sold under the trade name "Stadis 450".

In the examples of this invention it will be shown that the performance of certain electrical-conductivity additives improves as the proportion of unsaturation in additive, (a), (a'), or (a") increases, ie as the iodine value increases.

Other examples of electrical-conductivity additives include polysulfone/vinyl copolymer additives, as described in WO-A-01/81512; those described in WO-A-01/88064; and those described in U.S. Pat. Nos. 5,071,445 and 6,391,070.

Electrical-conductivity improver additives, if present, may be present in the additive composition in a concentration of 0.1 to 10, such as 0.1 to 5, for example 0.3 to 3, mass per cent of active ingredient based on the mass of the additive composition, or in any event in an amount resulting in a concentration of electrical-conductivity improver additive in the fuel compostion of 0.1 to 10, such as 0.5 to 5, especially 0.5 to 3, ppm by mass.

It may be found that the additive compositions of this invention suffer from oxidative degradation. Thus, in a further embodiment of this invention, the additive compositions of the invention additionally comprise, unless already provided as stated above, an anti-oxidant additive, (b), such as a free radical inhibitor. As examples of such additives, (b), there may be mentioned phenolic additives such as alkylated phenols, for example butylated hydroxytoluene (known as BHT) and t-butylhydroquinone (known as BHQ).

Anti-oxidant additives, if present, may be present in the additive composition in a concentration of 0.01 to 20, such as 0.01 to 1, for example 0.05 to 0.2, especially 0.05 to 0.15, mass per cent of active ingredient based on the mass of the additive composition. The use of anti-oxidants can also prevent the formation of species such as di-acids that can give rise to damage of in-line diesel fuel pumps.

Concentrates

The additive compositions of the invention can be provided without the need for a diluent or solvent. However, if required, they may be provided in the form of concentrates in admixture with a carrier or diluent liquid, for example as a solution or a dispersion, which is convenient as a means for incorporating the additive composition into bulk fuel oil, which incorporation may be done by methods known in the art. Such concentrates may also contain other additives as required and preferably contain from 3 to 75, more preferably 3 to 60, most preferably 10 to 50, mass % of the additives, preferably in solution in solvent. Examples of carrier liquid are organic solvents including hydrocarbon solvents, for example petroleum fractions such as naphtha, kerosene, diesel and heater oil; aromatic hydrocarbons such as aromatic fractions, e.g. those sold under the 'SOLVESSO' tradename; paraffinic hydrocarbons such as hexane and pentane and isoparaffins; and oxygenated solvents such as alcohols. The carrier liquid must, of course, be selected having regard to its compatibility with the additive and with the fuel. The concentrates are added to the bulk fuel oil in amounts sufficient to supply the treat rate of additive required.

The additive compositions of the invention, with or without diluent or solvent, may be incorporated into bulk fuel oil by methods such as those known in the art. If co-additives are required, they may be incorporated into the bulk fuel oil at the same time as or at a different time from the additives of the invention.

Fuel Oil Compositions

The fuel oil may be a petroleum-based fuel oil, suitably a middle distillate fuel oil, ie a fuel oil obtained in refining crude oil as the fraction between the lighter kerosene and jet fuels fraction and the heavy fuel oil fraction. Such distillate fuel oils generally boil above about 100° C. The fuel oil can comprise atmospheric distillate or vacuum distillate, or cracked gas oil or a blend in any proportion of straight run and thermally and/or catalytically cracked and/or hydroprocessed distillates. The most common petroleum-based fuel oils are kerosene, jet fuels and preferably diesel fuel oils.

The sulphur content of the fuel oil may be 2000 or less, preferably 500 or less, more preferably 50 or less, most preferably 10 or less, ppm by mass based on the mass of the fuel oil. The art describes methods for reducing the sulphur content of hydrocarbon middle distillate fuels, such methods including solvent extraction, sulphuric acid treatment, and hydrodesulphurisation.

Preferred fuel oils have a cetane number of at least 40, preferably above 45 and more preferably above 50. The fuel oil may have such cetane numbers prior to the addition of any cetane improver or the cetane number of the fuel may be raised by the addition of a cetane improver.

More preferably, the cetane number of the fuel oil is at least 52.

Advantageously, the fuel oils are those that have low solvency properties caused by low aromatic concentrations (eg below 30, below 25, below 20, below 15, below 10, or below 5, mass per cent), and/or those that are required to operate at low temperatures such as at −5, −10, −15, or −20 C. or lower.

Other examples of fuel oils include jet-fuels; Fischer-Tropsch fuels; biofuels such as fuels made from vegetable matter such as rape seed methyl ester; and diesel/alcohol or diesel/water emulsions or solutions. Fischer-Tropsch fuels, also known as FT fuels, include those described as gas-to-liquid fuels and coal conversion fuels. To make such fuels, syngas ($CO+H_2$) is first generated and then converted to normal paraffins by a Fischer-Tropsch process. The normal paraffins may then be modified by processes such as catalytic cracking/reforming or isomerisation, hydrocracking and hydroisomerisation to yield a variety of hydrocarbons such as iso-paraffins, cyclo-paraffins and aromatic compounds. The resulting FT fuel can be used as such or in combination with other fuel components and fuel types such as those mentioned in this specification. WO-A-0104239; WO-A-0015740; WO-A-0151593; WO-A-9734969; and WO-155282 describe examples of diesel/water emulsions. WO-A-0031216; WO-A-9817745; and WO-A-024 8294 describe examples of diesel-ethanol emulsions/mixtures.

The concentration of the additive composition in the fuel oil may, for example, be in the range of 10 to 5,000, for example 20 to 5,000, such as 50 to 2000, preferably 75 to 300, more preferably 100 to 200, ppm by mass of active ingredient per mass of fuel oil.

Co-additives

The additive compositions and/or the fuel compositions of the invention may additionally comprise one or more other additives or co-additives as indicated above. Examples include other lubricity-enhancing compounds; cold flow improvers such as ethylene-unsaturated ester copolymers, hydrocarbon polymers, polar nitrogen compounds, alkylated aromatics, linear polymer compounds and comb polymers; detergents; corrosion inhibitors (anti-rust additives); dehazers; demulsifiers; metal deactivators; antifoaming agents; combustion improvers such as cetane improvers; co-solvents; package compatibilisers; reodorants; and metallic-based additives such as metallic combustion improvers.

EXAMPLES

The invention will now be further illustrated with reference to the following examples.

The table below shows the composition of the additives used in the examples:

| | Acid Composition (%) | | | | |
|---|---|---|---|---|---|
| Additive | Polycyclic | Linear Saturated | Mono-unsaturated | Di-unsaturated | Tri-unsaturated |
| Stearic Acid (technical grade) | | 90 | | | |
| Linoleic Acid (technical grade) | | 8 | 25 | 67 | |
| Linolenic Acid | | | | | 99 |
| Rapeseed Acid | | 10 | 60 | 29 | |
| De-saturated Soya Acid Sample 1 | | 5 | 27 | 61 | 5 |
| De-saturated Soya Acid Sample 2 | | 3 | 29 | 57 | 5 |

-continued

| Additive | Acid Composition (%) | | | | |
|---|---|---|---|---|---|
| | Polycyclic | Linear Saturated | Mono-unsaturated | Di-unsaturated | Tri-unsaturated |
| Linseed Acid | | 9 | 21 | 16 | 51 |
| Tall Oil Fatty Acid (TOFA) | 2.7 | 2 | 31 | 58 (di- + tri-) | |
| Abietic Acid (technical grade 70%) | 70 | | | | |

Example 1

Additive compositions were prepared according to the table below and added to diesel fuel. Electrical conductivity measurements were then carried out according to IP 274/ASTM D 2624. The results are summarised in the tables below:

| Additive, ppm | Base fuel | Treated | Treated | Treated | Treated | Treated |
|---|---|---|---|---|---|---|
| Stadis 450 | | 3 | 3 | 3 | 3 | 3 |
| Rapeseed acid | | | 1000 | 1000 | | |
| Abietic acid | | | | 200 | | 200 |
| Linolenic acid | | | | | 1000 | 1000 |
| Conductivity, pS/m | 4 | 242 | 324 | 130 | 399 | 123 |

| Additive, ppm | Base fuel | Treated | Treated | Treated |
|---|---|---|---|---|
| Stadis 450 | | 3 | 3 | 3 |
| Rapeseed acid | | | 100 | |
| TOFA | | | | 100 |
| Conductivity, pS/m | 0 | 252 | 400 | 300 |

"Stadis 450" is, as stated herein, a commercially-available conductivity improver (or antistatic additive).

The results indicate that:

- The presence of abietic acid has an adverse effect on the response of Stadis 450 antistatic additive.
- Fatty acids free of abietic acid do not exhibit the detrimental effect seen with these types of polycyclic acids.
- The fatty acids described above have shown a synergistic effect with Stadis 450. Such synergy is enhanced at high unsaturation levels.

Example 2

Fuel filterability tests were carried out at a variety of temperatures and storage times to assess the effect that various additives have on this parameter.

Testing Procedure

The extent to which the additive composition remains in solution at low temperatures or at least does not form a separate phase which can cause blocking of fuel oil lines or filters was measured using a known filterability test. The test was a method for measuring the filterability of fuel oil compositions at temperatures above their cloud point described in the Institute of Petroleum's Standard designated "IP 387/190" and entitled "Determination of filter blocking tendency of gas oils and distillate diesel fuels". In summary, a sample of the diesel fuel to be tested was passed at a constant rate of flow through a glass fibre filter medium: the pressure drop across the filter was monitored, and the volume of fuel oil passing the filter medium within the prescribed pressure drop measured. The filter blocking tendency of a fuel composition can be described as the pressure drop across the filter medium for 300 ml of fuel to pass at a rate of 20 ml/min. Reference is to be made to the above-mentioned standard for further information. In assessing the additive composition of the present invention, this method was adapted by conducting the measurements at temperatures lower than specified in the standard.

When failure occurred at a specific temperature, tests at lower temperature were not carried out. When a pass occurred at a specific temperature, tests at higher temperature were not carried out.

Results

| Pressure (psi) | Rating |
|---|---|
| 0-<15 | Pass within 15 minutes |
| 15 before the end of test | Fail (time of failure) |

| Additive | Storage Temperature (° C.) | Storage Time (days) | Pressure, psi (Time of Failure) |
|---|---|---|---|
| 1000 ppm linoleic acid (tech grade) | −10 | 1 | 5.2 |
| | −10 | 3 | 2.4 |
| | −10 | 7 | 2.6 |
| | −10 | 16 | 2.8 |
| | −20 | 1 | 4.6 |
| | −20 | 3 | 5.2 |
| | −20 | 7 | 6.8 |
| | −20 | 16 | 6.6 |
| 1000 ppm stearic acid (tech grade) | 0 | 1 | 15 (33 s) |
| | −10 | 1 | 15 (12 s) |
| 1000 ppm linoleic acid (tech grade) + 200 ppm abietic acid (tech grade) | 0 | 1 | 15 (1 min 33 s) |
| | −10 | 1 | 15 (1 min 48 s) |

The results indicate that:

- Polycyclic acids, e.g. abietic acid, have poor solubility behaviour at low temperatures resulting in loss of filterability.
- An increase of the level of unsaturation in the fatty acids tested leads to improved fuel filtration particularly at low fuel temperatures.

Example 3

A series of experiments to assess the storage stability of acid: Solvesso 150 mixtures were conducted using selected fatty acids. "Solvesso 150" is a commercially available hydrocarbon solvent. The following formulations had been stored for 14 days over a range of temperatures.

| Low T mp rature Stability of Acid:Solvesso 150 Mixtur s | | | | | | | | | |
|---|---|---|---|---|---|---|---|---|---|
| | Desaturated S ya Acid 2 | | | TOFA | | | Rapeseed Acid | | |
| Acid:Solvesso 150 | 1:1 | 1:2 | 1:3 | 1:1 | 1:2 | 1:3 | 1:1 | 1:2 | 1:3 |
| 0° C. | Clear | Clear | Clear | Clear | Clear | Clear | 20% ppt | Clear | Clear |
| −10° C. | Clear | Clear | Clear | xtals | Clear | Clear | 60% ppt | 25% ppt | 10% ppt |
| −20° C. | 10% ppt | Clear | Clear | 20% ppt | 10% ppt | Xtals | Solid | 60% ppt | 30% ppt |

Xtals = small number of crystals
Ppt = precipitate

The results clearly indicate that the desaturated soya acid composition shows improved storage stability over the TOFA and rapeseed acid compositions.

Example 4

Chemical Stability of Fatty Acids

Samples of various fatty acids, with and without anti-oxidants or free-radical inhibitors, were stored in the presence of air at 60° C. for 2 weeks (and in some cases for 19 days). The starting materials and stored samples were then analyzed by proton nmr spectroscopy.

The signals in the spectra of the starting materials were integrated and those that were due to the —CH2COOH protons (having a chemical shift around 2.3 ppm) were set to a particular reference value. The integral values of the signals in the spectra of the stored samples were similarly referenced and then compared with those of the starting materials to give an indication of any degradation.

The specific regions of the spectra that were compared were around 5.4 ppm for the —HC═CH— protons, around 2.75 ppm for the ═C—$CH_2$—C═ protons and around 2.05 ppm for the ═C—$CH_2$— protons. The results are shown in the table below, which shows the % change of the integral values between the starting materials and the stored samples.

It can be seen that the rapeseed acid was relatively stable but the stability was improved by the addition of t-butyl hydroquinone (BHQ). Partially de-saturated soya and linseed acids, which contain more polyunsaturated acids, were much less stable but, again, the addition of anti-oxidants or free-radical inhibitors, particularly BHQ and hydroquinone, improved the stability to at least that of the rapeseed acid.

The preferred anti-oxidants were aromatic, more preferably phenolic derivatives and most preferably BHQ, hydroquinone and BHT.

| | NMR Analysis: % Change in Integral Values from Starting Material | | |
|---|---|---|---|
| Sample | —HC═CH— (5.4 ppm) | ═C—CH2—C═ (2.75 ppm) | ═C—CH2— (2.05 ppm) |
| rapeseed acid | −4.4 | −5.3 | −3.0 |
| *rapeseed acid + 1,000 ppm BHT | −4.9 | −5.3 | −4.4 |
| rapeseed acid + 1,000 ppm BHQ | −1.2 | −3.3 | −1.6 |
| partially de-saturated soya acid (sample 1) | −18.8 | −25.2 | −15.6 |
| *partially de-saturated soya acid + 1,000 ppm BHT | −5.1 | −6.5 | −4.5 |
| partially de-saturated soya acid + 1,000 ppm BHQ | −2.6 | −4.8 | −4.1 |
| linseed acid | −12.8 | −18.9 | −11.9 |
| linseed acid + 2000 ppm BHT | −3.0 | −4.6 | −2.3 |
| linseed acid + 4000 ppm BHT | −3.0 | −2.3 | −1.9 |
| linseed acid + 10,000 ppm BHT | −2.8 | −2.8 | −2.1 |
| linseed acid + 1000 ppm phenothiazine | −2.3 | −2.2 | −1.5 |
| linseed acid + 10,000 ppm phenothiazine | −2.9 | −3.7 | −2.2 |
| linseed acid + 1000 ppm BHQ | −0.9 | −1.4 | −0.1 |
| linseed acid + 10,000 ppm BHQ | 0.5 | 0.2 | 0.6 |
| linseed acid + 1000 ppm HTEMPO | −11.5 | −15.3 | −10.2 |
| linseed acid + 10,000 ppm HTEMPO | −7.6 | −9.8 | −5.6 |
| linseed acid + 1000 ppm TEMPO | −12.4 | −16.0 | −9.8 |
| linseed acid + 1000 ppm hydroquinone | −1.1 | −1.8 | −0.8 |
| linseed acid + 1000 ppm 4-methoxyphenol | −2.8 | −3.5 | −3.0 |
| linseed acid + 1000 ppm di-p-tolylamine | −3.2 | −4.4 | −2.7 |
| linseed acid + 1000 ppm tetramethylthiuram disulphide | −3.9 | −5.7 | −3.1 |
| linseed acid + 1000 ppm 1,4-naphthoquinone | −7.2 | −8.8 | −5.9 |
| linseed acid + 1000 ppm t-butylcatechol | −12.3 | −15.2 | −9.4 |

*19 days storage
TEMPO: 2,2,6,6-tetramethyl-1-piperidinyloxy, free radical
HTEMPO: 4-hydroxy-2,2,6,6-tetramethyl-1-piperidinyloxy, free radical

What is claimed is:

1. An additive composition that is free of polycyclic carboxylic acids and of acid derivatives thereof, for a fuel oil composition, comprising: an additive, (a), comprising salt derivatives of a plurality of monocarboxylic acids, each having from 10 to 24 carbon atoms, less than 7 mass % of which acids from which salt derivatives are derived having a linear chain and being saturated, and the balance being unsaturated, at least 35 mass % of said balance being polyunsaturated.

2. An additive composition that is free of polycyclic carboxylic acids and of acid derivatives thereof, for a fuel oil composition, comprising or obtained by mixing:

an additive, (a'), comprising salt derivatives of a plurality of monocarboxylic acids, each having from 10 to 24 carbon atoms, less than 7 mass % of which acids from which salt derivatives are derived having a linear chain and being saturated, and the balance being unsaturated, at least 35 mass % of said balance being polyunsaturated; and either or both of an additive, (b), in the form of an anti-oxidant additive and an additive, (c), in the form of an electrical-conductivity improver additive.

3. The additive composition as claimed in claim 1 additionally comprising or obtained by mixing: an additive, (b), in the form of an anti-oxidant additive.

4. The additive composition as claimed in claim 1 additionally comprising or obtained by mixing: an additive, (c), in the form of an electrical-conductivity improver additive.

5. The additive composition as claimed in claim 1 wherein a major proportion of the derivatives of the monocarboxylic acid has 18 carbon atoms.

6. The additive composition as claimed in claim 5 wherein the acids include oleic acid, linolenic acid and linoleic acid.

7. The additive composition as claimed in claim 1 additionally comprising, or obtained by mixing, a carrier or diluent.

8. A fuel oil composition that is free of polycyclic carboxylic acids and of acid derivatives thereof comprising, or obtained by mixing, a fuel oil in a major proportion, and an additive composition as claimed in claim 1, in a minor proportion.

9. The fuel oil composition as claimed in claim 8 wherein the fuel oil is a middle distillate fuel, a jet fuel or a Fischer-Tropsch fuel.

10. The fuel oil composition as claimed in claim 9 wherein the fuel oil is a middle distillate fuel having a cloud point of −5° or lower.

11. The fuel oil composition as claimed in claim 9 where the fuel oil is a middle distillate fuel containing less then 500 ppm by mass of sulphur.

12. A method of operating an internal combustion engine using, as fuel for the engine, a fuel oil composition as claimed in claim 8.

13. The method of claim 12 wherein the fuel oil is a middle distillate fuel containing less than 500 ppm by mass of sulphur.

* * * * *

UNITED STATES PATENT AND TRADEMARK OFFICE

CERTIFICATE OF CORRECTION

PATENT NO. : 7,597,725 B2
APPLICATION NO. : 10/675171
DATED : October 6, 2009
INVENTOR(S) : Rinaldo Caprotti et al.

It is certified that error appears in the above-identified patent and that said Letters Patent is hereby corrected as shown below:

In column 12, claim 10, line 19, delete "-5°" and insert therefore -- -5°C --.

Signed and Sealed this

Twenty-ninth Day of December, 2009

David J. Kappos

David J. Kappos
*Director of the United States Patent and Trademark Office*